US005472817A

United States Patent [19]

Shibano et al.

[11] Patent Number: 5,472,817

[45] Date of Patent: Dec. 5, 1995

[54] CARRIER FOR DEVELOPMENT OF ELECTROSTATIC LATENT IMAGES

[75] Inventors: Hiroshi Shibano, Takarazuka; Tomoharu Nishikawa, Osaka; Koichi Takenaka, Amagasaki, all of Japan

[73] Assignee: Minolta Co., Ltd., Osaka, Japan

[21] Appl. No.: 281,563

[22] Filed: Jul. 28, 1994

[30] Foreign Application Priority Data

Jul. 28, 1993 [JP] Japan ..... 5-185922

[51] Int. Cl.[6] ..... G03G 9/107

[52] U.S. Cl. ..... 430/106.6; 430/108; 430/111; 430/137

[58] Field of Search ..... 430/106.6, 108, 430/111

[56] References Cited

U.S. PATENT DOCUMENTS

| | | | |
|---|---|---|---|
| 4,600,675 | 7/1986 | Iwasa et al. | 430/106.6 |
| 4,822,709 | 4/1989 | Ohtani et al. | 430/106.6 |
| 4,847,176 | 7/1989 | Sano et al. | 430/106.6 |
| 4,868,082 | 9/1989 | Kohri et al. | 430/106.6 |
| 4,879,198 | 11/1989 | Tavernier et al. | 430/106.6 |
| 4,902,597 | 2/1990 | Takeda et al. | 430/108 X |
| 5,013,626 | 5/1991 | Matsumura et al. | 430/111 X |

*Primary Examiner*—Roland Martin

*Attorney, Agent, or Firm*—Bruns, Doane, Swecker & Mathis

[57] ABSTRACT

The present invention provide a carrier for development of electrostatic latent images, comprising magnetic powder dispersed in binder resin, the carrier having a mean particle size in a range of 30 to 80 μm and satisfying the following relational expression:

$$(x)^2/\phi^2 \geqq 9.0$$

wherein x represents mean particle size of the carrier and $\phi^2$ represents variance of particle size distribution.

The carrier of the present invention is superior in chargeability and fluidity and free from occurrence of carrier adhesion even when used in combination with small particle size toner and which can form excellent copy images.

18 Claims, 4 Drawing Sheets

CARRIER FOR DEVELOPMENT OF ELECTROSTATIC LATENT IMAGES

BACKGROUND OF THE INVENTION

1. Field of the Invention

The present invention relates to carriers used in developers for development of electrostatic latent images and, more particularly, to a carrier having magnetic powder dispersed in binder resin.

2. Description of the Prior Art

As developers for use with electrophotographic copying machines or printers, there have been known two-component developers composed of a toner and a magnetic carrier such as iron powder. In any developing method using such a two-component developer, the magnetic strength among carrier particles is so strong that ears of the magnetic brush harden, causing a problem that white lines may appear in black-solid images. Also, the iron powder carrier itself is low in volume electrical resistivity. Therefore, when the toner concentration in the developer has lowered due to continuous use or the like, electrical charges on the electrostatic latent image supporting member may escape via the carrier so that the latent image is disordered, causing defects or other damages in copy images, or electrical charges may be injected from the developing sleeve to the carrier so that the carrier adheres to the image portion. Further, if a hard carrier such as iron powder has adhered to the electrostatic latent image supporting member, the surface of the electrostatic latent image support member may be damaged when residual toner is removed.

To solve the above problems, a binder type carrier has been proposed in which magnetic fine powder is dispersed in binder resin. The binder type carrier is generally low in magnetization level within a magnetic field, compared with iron powder carrier or the like, so that the ears of the magnetic brush become soft. Thus, the binder type carrier has an advantage that excellent images free from white lines due to carrier can be obtained.

However, even with the use of the binder type carrier, especially when it is used in combination with a toner having a particle size as small as 3 to 9 μm, there may arise some problems that the chargeability of toner is insufficient or the fluidity of developer is insufficient. Moreover, there may occur carrier adhesion that the carrier adheres to non-image portions of the electrostatic latent image supporting member, making image noise when developed, as still another problem.

SUMMARY OF THE INVENTION

The present invention is to provide a carrier which is superior in chargeability and fluidity and free from occurrence of carrier adhesion even when used in combination with small particle size toner and which can form excellent copy images.

The present invention relates to a carrier for development of electrostatic latent images, comprising magnetic powder dispersed in binder resin, the carrier having a mean particle size in a range of 30 to 80 μm and satisfying the following relational expression:

$$(x)^2/\phi^2 \geqq 9.0$$

wherein x represents mean particle size of the carrier and $\phi^2$ represents variance of particle size distribution.

DETAILED DESCRIPTION OF THE INVENTION

Figure 1:
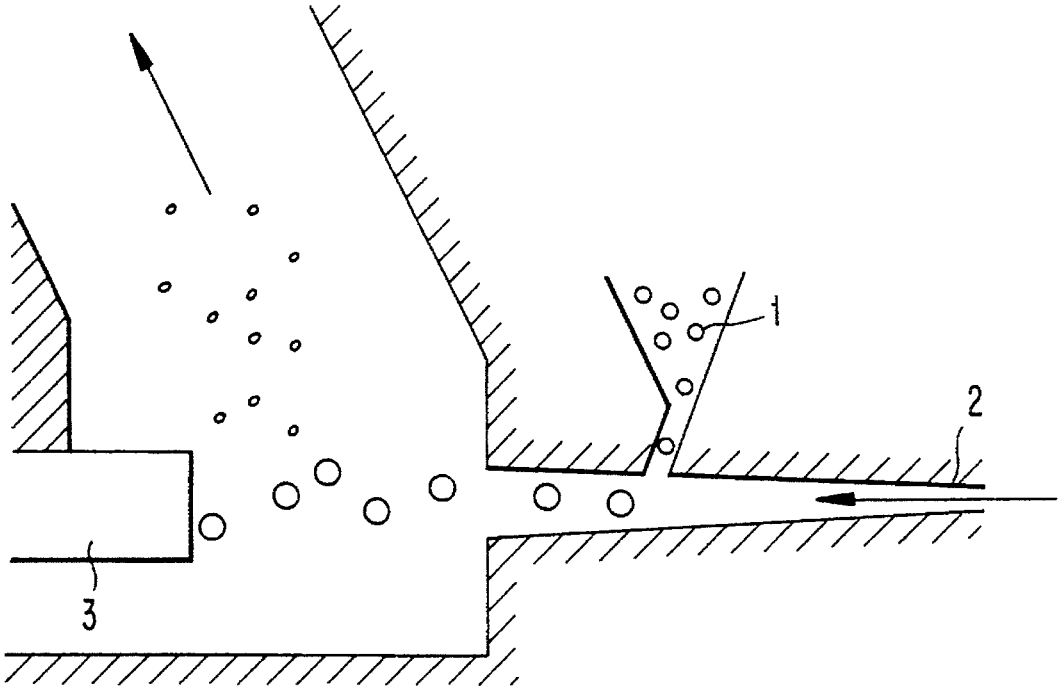
FIG. 1 is a schematic view showing a jet mill.

The present invention provides a carrier which is superior in chargeability and fluidity and free from occurrence of carrier adhesion even when used in combination with small particle size toner and which can form excellent copy images.

The present inventors have found that the aforementioned problems of insufficient chargeability and fluidity as well as carrier adhesion, which would be involved when small particle size toner and the binder type carrier are used in combination, can be attributed to the contents of small particle size carrier-particles and large particle size carrier-particles contained in the carrier.

The present invention has accomplished the above object by controlling a particle size distribution of carrier to a specified range.

The present invention relates to a carrier for development of electrostatic latent images, having magnetic powder dispersed in binder resin, the carrier being characterized in that its mean particle size is in a range of 30 to 80 μm and the following relational expression is satisfied:

$$(x)^2/\phi^2 \geqq 9.0$$

wherein x represents mean particle size and $\phi^2$ represents variance of particle size distribution.

The carrier of the present invention has a value of $(x)/^2/\phi^2$ wherein x represents mean particle size, $\phi^2$ represents variance of particle size distribution) being not smaller than 9.0, preferably not smaller than 10.0. When the value is smaller than 9.0, small particle size carriers and large particle size carriers increase in their proportions, resulting in insufficient chargeability and fluidity as well as occurrence of carrier adhesion.

The carrier of the present invention has a mean particle size in the range of 30 to 80 μm, preferably 30 to 70 μm. When the mean particle size of the carrier is smaller than 30

μm, carrier adhesion to the electrostatic latent image supporting member is likely to occur. When it is larger than 80 μm, brushing nonuniformities may take place such as in ordinary iron powder carrier, resulting in unclear copy images, and moreover use of the carrier in combination with small particle size toner having a mean particle size of 3 to 9 μm may easily incur insufficient charge amounts of toner.

Examples of the binder resin used for the carrier of the present invention are polystyrene resins, poly(metha)acrylic resins, styrene-acrylic copolymer resins, polyolefin resins, polyester resins, epoxy resins, and the like.

Examples of the magnetic powder used for the carrier of the present invention are such metals as iron, nickel and cobalt, alloys or mixtures of these metals with such metals as zinc, antimony, aluminum, lead, tin, bismuth, beryllium, manganese, selenium, tungsten, zirconium and vanadium, mixtures thereof with such metal oxides as iron oxide, titanium oxide and magnesium oxide, and ferromagnetic ferrite, magnetite and their mixtures.

The particle size of these magnetic powders is desirably not greater than 5 μm, preferably not greater than 2 μm, and more preferably 0.1 to 1 μm in primary particle size, from the viewpoint of uniform dispersion in the binder resin.

A blending ratio of the binder resin to the magnetic powder is 100 to 900 parts by weight, preferably 400 to 800 parts by weight, and more preferably 500 to 700 parts by weight of magnetic powder on the basis of 100 parts by weight of the resin. When the blending ratio of magnetic powder is more than 900 parts by weight, the magnetic powder forms secondary powder without being uniformly dispersed, so that the carrier becomes brittle. On the other hand, when the blending ratio of magnetic powder is less than 100 parts by weight, sufficient magnetism cannot be obtained.

The carrier of the present invention may also contain a dispersing agent, such as carbon black, silica, titania and alumina. The dispersing agent, if contained, allows the uniform dispersibility of magnetic powder in the binder resin to be improved. A content of the dispersing agent is preferably 0.01 to 3% by weight relative to the carrier.

The carrier of the present invention may be prepared, for example, by a method in which the binder resin and the magnetic powder are mixed and heated at a specified mixing ratio and after cooling, the mixture is pulverized and classified, or by a method in which the binder resin is dissolved into a solvent and, after the magnetic powder is dispersed into the resin solution, the resultant is spray-dried.

When the carrier is prepared by the above mixing and pulverizing process, a jet mill as shown in FIG. 1 is commonly used as the mill for use in the step of pulverizing particles.

In the jet mill in FIG. 1, coarsely pulverized particles 1 are accelerated by a high speed air stream spouting from a jet nozzle 2 to intensely collide against a collision plate 3, thus being pulverized.

Figure 2A:
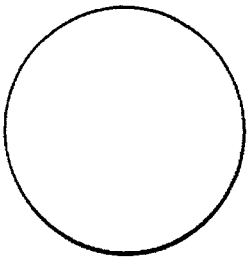
FIG. 2 is a schematic view showing the pulverizing surface and side face of a collision plate (flat plate type).
Figure 2B:
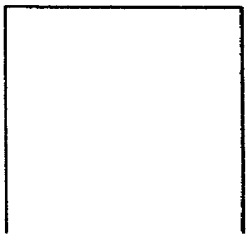
Figure 3A:
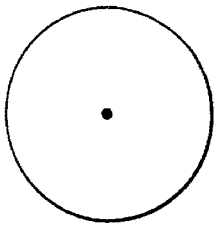
FIG. 3 is a schematic view showing the pulverizing surface and side face of a collision plate (conical type).
Figure 3B:
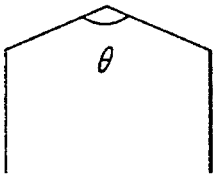

When such a jet mill is used to prepare the above-described carrier, a high content ratio of the magnetic powder makes it difficult to pulverize the particles into uniform particle size. The collision plate of such a jet mill is conventionally a collision plate whose surface for pulverization of particles is flat as illustrated in FIG. 2 or another whose surface for pulverization of particles is conical as illustrated in FIG. 3. When the collision plate of FIG. 2 is used for the aforementioned pulverization of carrier, the pulverizability is very successful but overpulverization may occur, causing generation of a large amount of fine powder, and resulting in a wide particle size distribution. When the collision plate of FIG. 3 is used, the particle size distribution is rather narrow but a poor pulverizability results in less yield per unit time.

Figure 4A:
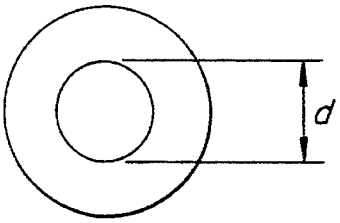
FIG. 4 is a schematic view showing the pulverizing surface and side face of a first modification of a collision plate.
Figure 4B:
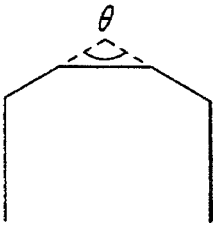
Figure 5A:
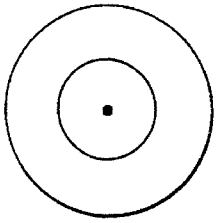
FIG. 5 is a schematic view showing the pulverizing surface and side face of a second modification of a collision plate.
Figure 5B:
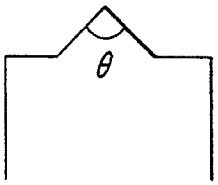

Thus, when a collision plate of a shape as shown in FIG. 4 or FIG. 5 is used, especially when the collision plate as illustrated in FIG. 4 is used, it has been found that a narrow particle size distribution is obtained while the pulverizability can be maintained. That is, use of a collision plate having the shape of FIG. 4 is effective to the pulverization of particles whose specific gravity is rather greater, like the carrier of the present invention, in terms of control of the particle size distribution of given particles and the pulverizing efficiency. Values of 8 and d of the collision plate are set to proper ones depending on hardness and size of the object materials to be pulverized. In addition, a collision plate of FIG. 4 with $100° \leqq \theta 140°$ and $6\ mm \leqq d \leqq 16\ mm$ is desirably used for the preparation of the carrier of the present invention.

Further, the carrier of the present invention may be heated after the classifying step. The heating process is desirably a process of instantaneous heating by spouting the carrier into an air stream. The equipment for such heating may be, for example, Surfusing System (made by Nihon Pneumatic Kogyo K.K.) or the like. The heating temperature is preferably in the range of about 150° to 350° C.

Such heating process allows the carrier to be modified in its surface state. Thus, a carrier can be obtained which has such an excellent durability that the magnetic powder will not be separated even when the carrier is subjected to continuous use.

The toner used in combination with the carrier of the present invention may be a known toner which has a mean particle size of 2 to 20 μm. In particular, when a small particle size toner having a mean particle size of 3 to 9 μm is used in combination with the carrier of the present invention, a remarkable effect can be exerted so that the problems of insufficient fluidity and poor chargeability in small particle size toners can be successfully resolved.

Concrete examples of the present invention are now described hereinbelow, but the scope of the present invention is not limited to these examples.

Preparation Example of Carrier 1

One hundred parts by weight of polyester resin (Tafton NE-1110, made by Kao K.K.), 500 parts by weight of ferrite powder (MFP-2, made by TDK K.K.), 2 parts by weight of carbon black (Ketchen Black EC, made by Lion Yushi K.K.), 1.5 parts by weight of silica (#200, made by Nihon Aerosil K.K.) were well mixed by means of a Henschel mixer. The mixture was melt and kneaded by a pressure kneader. The kneaded mixture was cooled and then coarsely pulverized by a feather mill. Thereafter, by using a jet mill (model IDS-II) loaded with a collision plate ($\theta$=120°, d=8 mm) of FIG. 4 as the collision plate, the mixture was finely pulverized at a milling air pressure of 2.5 $kg{\cdot}f/cm^2$, and classified in Multiplex. Thus, Carrier 1 with a mean particle size of 69.5 μm and a value of $(x)^2/\phi^2$ of 11.33 was obtained.

Figure 6:
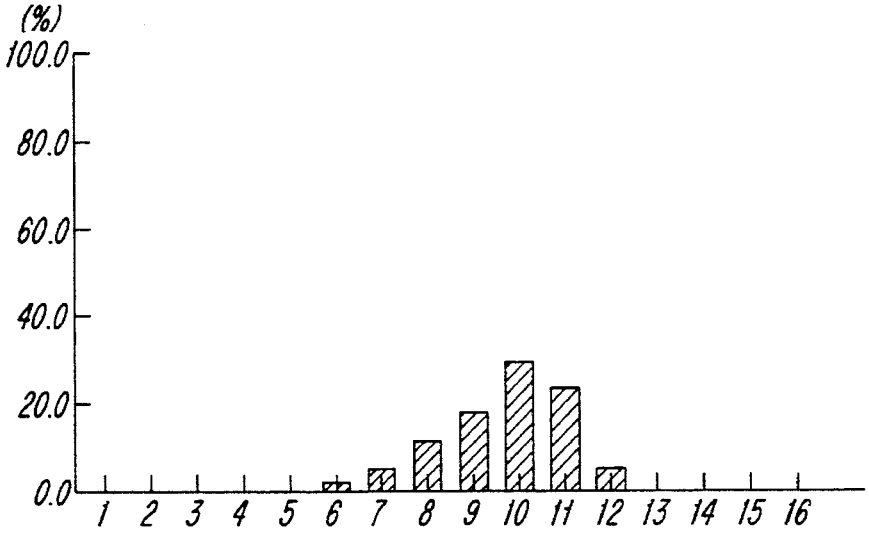
FIG. 6 is a graph showing particle size distribution of carrier 1.

Particle size distribution of the resulting carrier is shown in Table 1 and FIG. 6. The abscissa axis in FIG. 6 represents the channel of Table 1.

Preparation Example of Carrier 2

Figure 7:
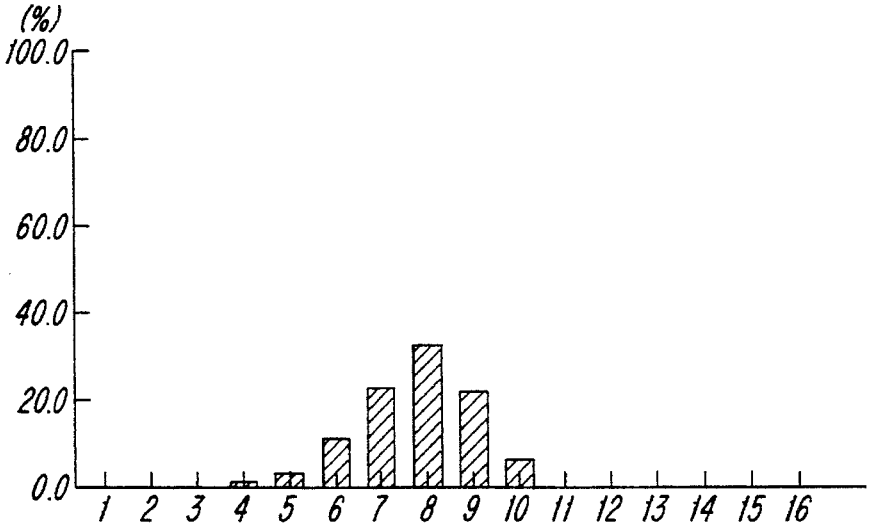
FIG. 7 is a graph showing particle size distribution of carrier 2.

In the same way as in the preparation example of Carrier 1 except that 600 parts by weight of ferrite powder was added and that the milling air pressure was 3.5 $kg{\cdot}f/cm^2$, Carrier 2 with a mean particle size of 43 μm and a value of $(x)^2/\phi^2$ of 12.43 was obtained. Particle size distribution of the resulting carrier is shown in Table 1 and FIG. 7.

Preparation Example of Carrier 3

Figure 8:
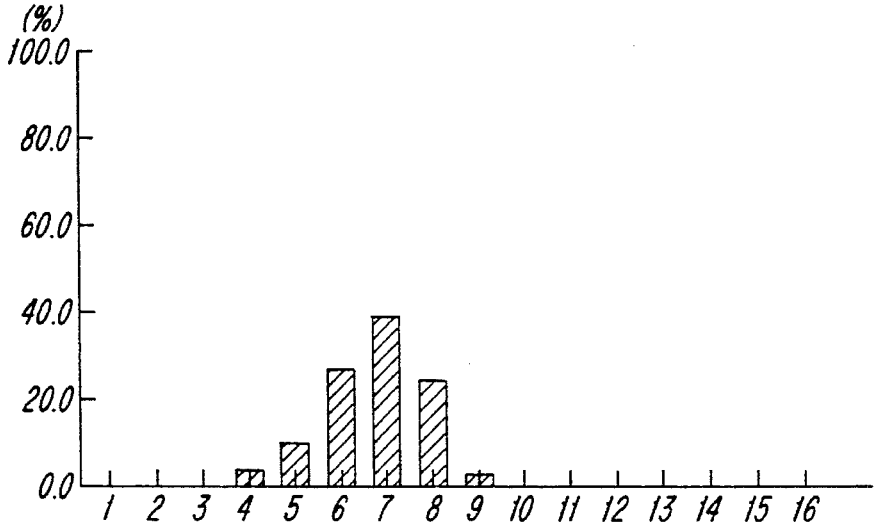
FIG. 8 is a graph showing particle size distribution of carrier 3.

In the same way as in the preparation example of Carrier 1 except that 700 parts by weight of ferrite powder was added and that the milling air pressure was 4.5 kg·f/cm$^2$, Carrier 3 with a mean particle size of 33 μm and a value of $(x)^2/\phi^2$ of 16.60 was obtained. Particle size distribution of the resulting carrier is shown in Table 1 and FIG. 8.

Preparation Example of Carrier 4

In the same way as in the preparation example of Carrier 1 except that the collision plate of FIG. 2 was used, carrier 4 with a mean particle size of 71 μm and a value of $(X)^2/\phi^2$ of 5.93 was obtained.

Figure 9:
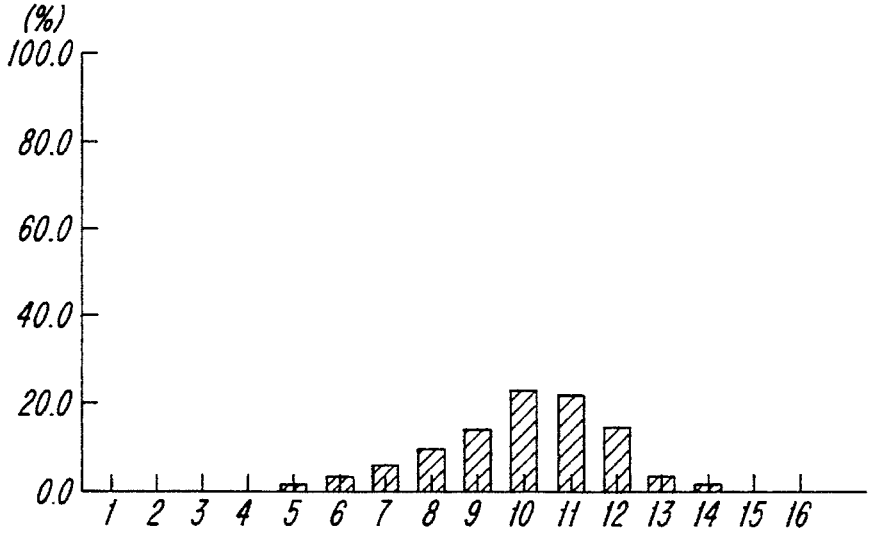
FIG. 9 is a graph showing particle size distribution of carrier 4.

Particle size distribution of the resulting carrier is shown in Table 1 and FIG. 9.

Preparation Example of Carrier 5

Figure 10:
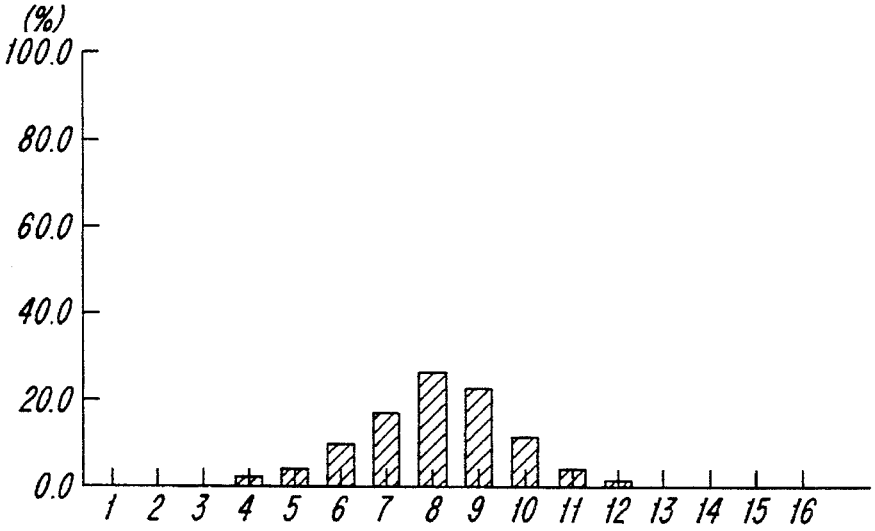
FIG. 10 is a graph showing particle size distribution of carrier 5.

In the same way as in the preparation example of Carrier 4 except that the milling air pressure was 3.5 kg·f/cm$^2$, Carrier 5 with a mean particle size of 46 μm and a value of $(X)^2/\phi^2$ of 6.85 was obtained. Particle size distribution of the resulting carrier is shown in Table 1 and FIG. 10.

Preparation Example of Carrier 6

Figure 11:
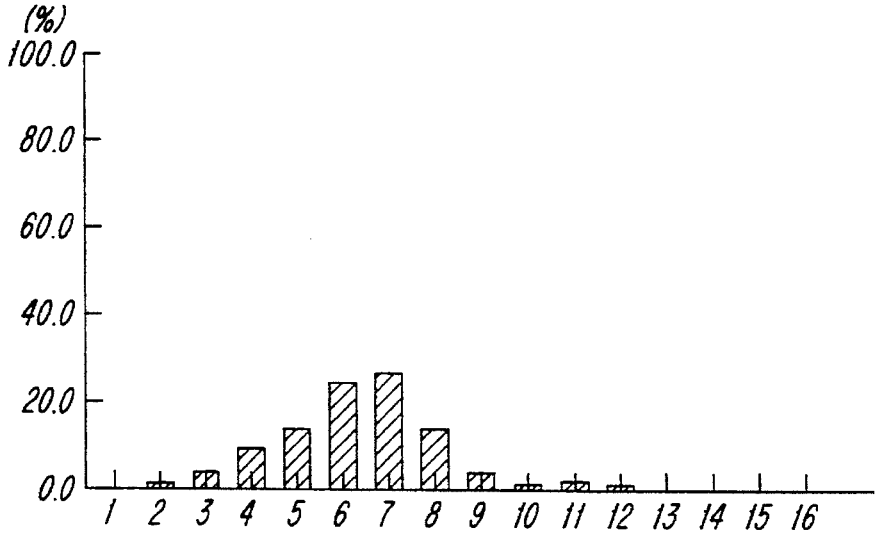
FIG. 11 is a graph showing particle size distribution of carrier 6.

In the same way as in the preparation example of Carrier 4 except that the milling air pressure was 4.5 kg·f/cm$^2$, Carrier 6 with a mean particle size of 31 μm and a value of $(X)^2/\phi^2$ of 4.85 was obtained. Particle size distribution of the resulting carrier is shown in Table 1 and FIG. 11.

-continued

| Component | Parts by weight |
|---|---|
| 60° C.) | |
| carbon black (MA #8, made by Mitsubishi Kasei Kogyo K.K.) | 8 |
| Nigrosine dye (Bontron N-01, made by Orient Kagaku Kogyo K.K.) | 5 |

The above materials were well mixed by a ball mill, and kneaded on a three-roll heated at 140° C. The kneaded mixture was left for cooling. After cooling the mixture was coarsely pulverized into a mean particle size of 2 mm by a hammer mill. Then it was pulverized into a mean particle size of 11 μm by Criptron and further finely pulverized by a jet mill. Then the resulting powder was air-classified. Thus a toner with a mean particle size of 8.5 μm was obtained.

Evaluation of Physical Properties (1) Particle Size of Carrier

For measurement of mean particle size of Carriers, the Coulter Counter TA-II model (made by Coulter Counter Co.) was used, and relative weight distribution for each particle size was measured by a 500 μm aperture tube.

(2) Variation of Electrical Charge Amount of Toner due to Stirring Strength

The above obtained toner (100 parts by weight) was mixed with Colloidal Silica R974 (0.1 part by weight) (made by Nihon Aerosil K.K.). This resulting toner was mixed with Carriers 1 through 6 at a toner-mixing ratio of 5% for 10 minutes by using a Vial Rotator to prepare developers. The developers were subjected to measure a charge amount of toner $Q_2$ (μC/g) under conditions of 25° C. and a humidity of 65%. Next, the developers were strongly stirred for 30 minutes by a paint conditioner, and then a charge amount of toner $Q_2$ (μC/g) was measured. A value of $|Q_1-Q_2|$ as the variation of charge amount due to stirring strength is shown

TABLE 1

| | Channel | | | | | | | |
|---|---|---|---|---|---|---|---|---|
| | 1 8.00~10.1 (μm) | 2 10.1~12.7 (μm) | 3 12.7~16.0 (μm) | 4 16.0~20.2 (μm) | 5 20.2~25.4 (μm) | 6 25.4~32.0 (μm) | 7 32.0~40.3 (μm) | 8 40.3~50.8 (μm) |
| Carrier 1 | 0.0 | 0.0 | 0.0 | 0.0 | 0.0 | 2.0 | 5.9 | 12.3 |
| Carrier 2 | 0.0 | 0.0 | 0.0 | 1.1 | 3.4 | 11.3 | 22.6 | 32.3 |
| Carrier 3 | 0.0 | 0.0 | 0.5 | 3.5 | 9.0 | 24.8 | 36.9 | 22.8 |
| Carrier 4 | 0.0 | 0.0 | 0.0 | 0.6 | 1.5 | 3.8 | 6.5 | 9.8 |
| Carrier 5 | 0.0 | 0.0 | 0.5 | 2.3 | 4.2 | 10.0 | 17.4 | 25.9 |
| Carrier 6 | 0.0 | 0.9 | 3.1 | 8.7 | 13.9 | 24.3 | 26.2 | 14.5 |

| | Channel | | | | | | | |
|---|---|---|---|---|---|---|---|---|
| | 9 8.00~10.1 (μm) | 10 10.1~12.7 (μm) | 11 12.7~16.0 (μm) | 12 16.0~20.2 (μm) | 13 20.2~25.4 (μm) | 14 25.4~32.0 (μm) | 15 32.0~40.3 (μm) | 16 40.3~50.8 (μm) |
| Carrier 1 | 19.1 | 30.5 | 24.4 | 6.0 | 0.0 | 0.0 | 0.0 | 0.0 |
| Carrier 2 | 22.0 | 7.1 | 0.2 | 0.0 | 0.0 | 0.0 | 0.0 | 0.0 |
| Carrier 3 | 2.5 | 0.0 | 0.0 | 0.0 | 0.0 | 0.0 | 0.0 | 0.0 |
| Carrier 4 | 13.9 | 22.5 | 21.5 | 14.9 | 3.6 | 1.6 | 0.0 | 0.0 |
| Carrier 5 | 22.5 | 11.4 | 4.1 | 1.7 | 0.0 | 0.0 | 0.0 | 0.0 |
| Carrier 6 | 3.9 | 1.5 | 2.2 | 0.7 | 0.0 | 0.0 | 0.0 | 0.0 |

| Component | Parts by weight |
|---|---|
| styrene-n-butylmethacrylate (softening point: 132° C., glass transition temperature: | 100 |

in Table 2.

(3) Carrier Adhesion

Each developer prepared in the above step (2) was evaluated practically by a copying machine EP-5400 (made by Minolta Camera K.K.). Results are shown in Table 2.

In Table 2, carrier adhesion was evaluated visually by checking carriers adhered onto copy images. The mark o shows that no carrier adhesion had occurred, Δ shows that carrier adhesion had occurred, but at such a level that it would not matter practically, and x shows that carrier adhesion is noticeable and problematic as image noise.

(4) Fluidity of Developer

Each developer prepared in the above step (2) was set in a developing unit for a copying machine EP-5400 (made by Minolta Camera K.K.). The transfer screw within the developing unit was adjusted so that the developer would not be unbalanced in the longer direction of the developing unit after a 10 minute idle rotation. The developing unit adjusted in this way was mounted to the copying machine and subjected to durability test with respect to copy. After 10,000 times of copy with regard to a black-solid image, image density was measured at two points 20 cm away from each other in the direction perpendicular to direction of paper path, and difference in density in the longer direction of the developing unit due to unbalance of the developer was measured. The image density was measured by Macbeth Reflective Densitometer.

This value was evaluated to be ranked as follows.

The symbol "o" represents that a value of the difference was 0.05 or less. The symbol "Δ" represents that a value of the difference was greater than 0.05 to smaller than 0.1. The symbol "x" represents that a value of the difference was greater than 0.1. The results are shown in Table 2.

TABLE 2

| | Carrier | Mean particle size x(μm) | $(x)^2/\sigma^2$ | Variation of charge amount | Carrier adhesion | Fluidity |
|---|---|---|---|---|---|---|
| Example 1 | 1 | 69.5 | 11.33 | 3.5 | o | o |
| Example 2 | 2 | 43.0 | 12.43 | 2.8 | o | o |
| Example 3 | 3 | 33.0 | 16.60 | 1.0 | o | o |
| Comparative Example 1 | 4 | 71.0 | 5.93 | 6.8 | Δ | x |
| Comparative Example 2 | 5 | 46.0 | 6.85 | 5.2 | x | x |
| Comparative Example 3 | 6 | 31.0 | 4.85 | 4.9 | x | x |

What is claimed is:

1. A carrier for development of electrostatic latent images, comprising magnetic powder dispersed in binder resin, the carrier having a mean particle size in a range of 30 to 80 μm and satisfying the following relational expression:

$$(x)^2/\phi^2 \geqq 9.0$$

wherein x represents mean particle size of the carrier and $\phi^2$ represents variance of particle size distribution.

2. The carrier according to claim 1, wherein the mean particle size of the carrier is in a range of 30 to 70 μm.

3. The carrier according to claim 1, wherein $$(x)^2/\phi^2 \geqq 10.0.$$

4. The carrier according to claim 1, wherein the magnetic powder has a primary particle size of 5 μm or less.

5. The carrier according to claim 4, wherein the magnetic powder has a primary particle size of 0.1 to 1 μm.

6. The carrier according to claim 1, wherein a ratio of the binder resin to the magnetic powder is 100 to 900 parts by weight of the magnetic powder relative to 100 parts by weight of the binder resin.

7. The carrier according to claim 1, wherein a ratio of the binder resin to the magnetic powder is 400 to 800 parts by weight of the magnetic powder relative to 100 parts by weight of the binder resin.

8. The carrier according to claim 1, wherein the binder resin is at least one resin selected from a group consisted of polystyrene resins, poly(metha)acrylic resins, styrene-acrylic resins, polyolefin resins, polyester resins and epoxy resins.

9. The carrier according to claim 1, further comprising at least one dispersing agent selected from a group consisted of carbon black, silica, titania and alumina.

10. The carrier according to claim 9, wherein a content of the dispersing agent is 0.01 to 3% by weight.

11. The carrier according to claim 1 prepared by the steps comprising:

mixing the binder resin and the magnetic powder by a mixer, melting and kneading the resulting mixture by a kneader, cooling the kneaded mixture, pulverizing coarsely the cooled mixture by a mill, and pulverizing finely the coarsely pulverized particles by a jet mill.

12. The carrier according to claim 11, prepared by the steps further comprising a step of classifying the finely pulverized particles obtained in the finely pulverizing step.

13. The carrier according to claim 11, prepared by the steps further comprising a step of heating the finely pulverized particles obtained in the finely pulverizing step.

14. The carrier according to claim 11, wherein the finely pulverizing step is performed by making the coarsely pulverized particles coming into collision with a collision portion of a collision plate of the jet mill by means of a high speed air stream.

15. The carrier according to claim 14, wherein the collision portion of the collision plate comprises:

a circular flat-plate collision surface formed by removing an end portion of a cone including its conical angle, the cone being protrudingly formed at a center portion of the collision plate, and a slanted collision surface formed on an outer peripheral portion adjacently connected to the flat-plate collision surface.

16. The carrier according to claim 15, wherein the cone has a conical angle θ of 100° to 140°.

17. The carrier according to claim 15, wherein the circular flat-plate collision surface has a diameter of 6 to 16 mm.

18. The carrier according to claim 14, wherein the collision portion of the collision plate comprises:

a conical collision surface protrudingly formed at a center portion of the collision plate, and an annular flat-plate collision surface formed on an outer peripheral portion adjacently connected to the conical collision surface.

* * * * *